US005860220A

United States Patent [19]

Gerd

[11] Patent Number: 5,860,220

[45] Date of Patent: Jan. 19, 1999

[54] APPARATUS AND METHOD FOR MARKING CUT LINES ON PIPE TO FORM A VARIETY OF PIPE FITTINGS AND BENDS

[76] Inventor: John A. Gerd, 4137 W. Cherrywood La., Milwaukee, Wis. 53209

[21] Appl. No.: 873,485

[22] Filed: Jun. 12, 1997

Related U.S. Application Data

[60] Provisional application No. 60/022,165 Jul. 19, 1996.

[51] Int. Cl. [6] ..... B43L 9/00

[52] U.S. Cl. ..... 33/529; 33/27.01; 33/DIG. 21

[58] Field of Search ..... 33/27.01, 27.03, 33/27.06, 27.07, 30.1, 529, DIG. 21

[56] References Cited

U.S. PATENT DOCUMENTS

| | | | |
|---|---|---|---|
| 1,051,689 | 1/1913 | Coleman | 33/27.07 |
| 2,749,622 | 6/1956 | Rasco | 33/529 |
| 3,742,581 | 7/1973 | Roodvoeis | 33/DIG. 21 |
| 4,367,593 | 1/1983 | Whitworth | 33/529 |
| 4,614,043 | 9/1986 | Nagano et al. | 33/529 |
| 4,616,418 | 10/1986 | Wade, III | 33/27.01 |
| 5,481,809 | 1/1996 | Rooney | 33/DIG. 21 |
| 5,651,184 | 7/1997 | Tutty | 33/529 |

FOREIGN PATENT DOCUMENTS

| | | | |
|---|---|---|---|
| 318327 | 1/1976 | U.S.S.R. | 33/529 |

*Primary Examiner*—G. Bradley Bennett
*Attorney, Agent, or Firm*—Quarles & Brady

[57] ABSTRACT

An apparatus for indicating lines along which cuts are to be made on a pipe has a clamp for attaching to the pipe. A longitudinal guide is fixedly attached to the clamp and a first bracket is slideably releasably coupled to the longitudinal guide at one of a plurality of locations. A pivot arm pivotally coupled to the first bracket and has a second bracket slideably coupled thereto at one of a plurality of positions. A laser attached to the second bracket projects a beam of light onto a surface of the pipe. A the pivot arm is rotated with respect to the first bracket the laser beam traces a line on the pipe along which a cut should be made. A marker is used to mark the line traced by the laser beam.

20 Claims, 3 Drawing Sheets

APPARATUS AND METHOD FOR MARKING CUT LINES ON PIPE TO FORM A VARIETY OF PIPE FITTINGS AND BENDS

This application claims the benefit of U.S. Provisional Application No. 60/022,165, filed Jul. 19, 1996.

BACKGROUND OF THE INVENTION

The present invention relates to devices for marking pipe with lines along which cuts are to be made.

Concrete sewer pipe usually is pre-cast in fixed lengths of straight pipe. If a particular installation requires a T-fitting for a sewer lateral or a junction for a vertical riser of a manhole, a first piece of pre-cast pipe is cut with an opening to accommodate the lateral or riser. Another piece of pipe corresponding to the size of the lateral or riser is placed into the opening. The reinforcing wire mesh, commonly called a cage, within each piece of pipe is exposed and welded together at the opening. Then concrete is used to patch the junction between the two pieces of concrete pipe to form a monolithic structure.

One of the problems encountered in this technique is cutting the hole of the proper size and shape to accommodate the lateral or riser pipe. Although this latter piece of pipe has a round cross-section, a non-circular hole must be cut in the first piece of pipe because of that pipe's curved surface. Because the dimensions of this hole heretofore could not be determined with accuracy, fabricators previously cut a much larger hole than was necessary thereby requiring a significant amount of patching to join the two pieces of pipe.

Similar rough approximation techniques are employed to produce angled sections of pipe and "wye" connections.

Therefore, it is desirable to provide a tool which will accurately mark an eclipse of the proper size to accommodate the lateral or riser piece of pipe.

SUMMARY OF THE INVENTION

An object of the present invention is to provide an apparatus for accurately indicating lines along which cuts are to be made on a pipe.

Another object of the present invention is to provide such an apparatus that may be adjusted to indicate cut lines in a variety of desired patterns on a pipe.

These and other objectives are satisfied by an apparatus which includes a longitudinal guide attached to a support that orients the longitudinal guide in a fixed location with respect to a pipe to be cut. A first bracket is releasably coupled at one position of a plurality of user selectable positions along the longitudinal guide, and has a fastener to secure the first bracket at the one position. A pivot arm is pivotally coupled to the first bracket. A second bracket is movably coupled at a given position of a plurality of user selectable positions along the pivot arm. A position projector, such as a laser for example, is attached to the second bracket to transfer the location of the second bracket onto a surface of the pipe.

To mark a curved cut line on a section of pipe the first bracket is aligned with the center point of the curved cut line. The second bracket is secured to the pivot arm at a distance from the first bracket which distance corresponds to the radius of the curved cut line. The pivot arm then is rotated about the first bracket so that the position projector traces the cut line on the surface of the pipe. The user employs a marking device to mark the traced cut line on the pipe surface.

DETAILED DESCRIPTION OF THE INVENTION

Although the present apparatus is being described in the context of concrete sewer pipe, those skilled in the art will appreciate that this apparatus can be utilized with pipes made of other materials and for other applications.

Figure 2:
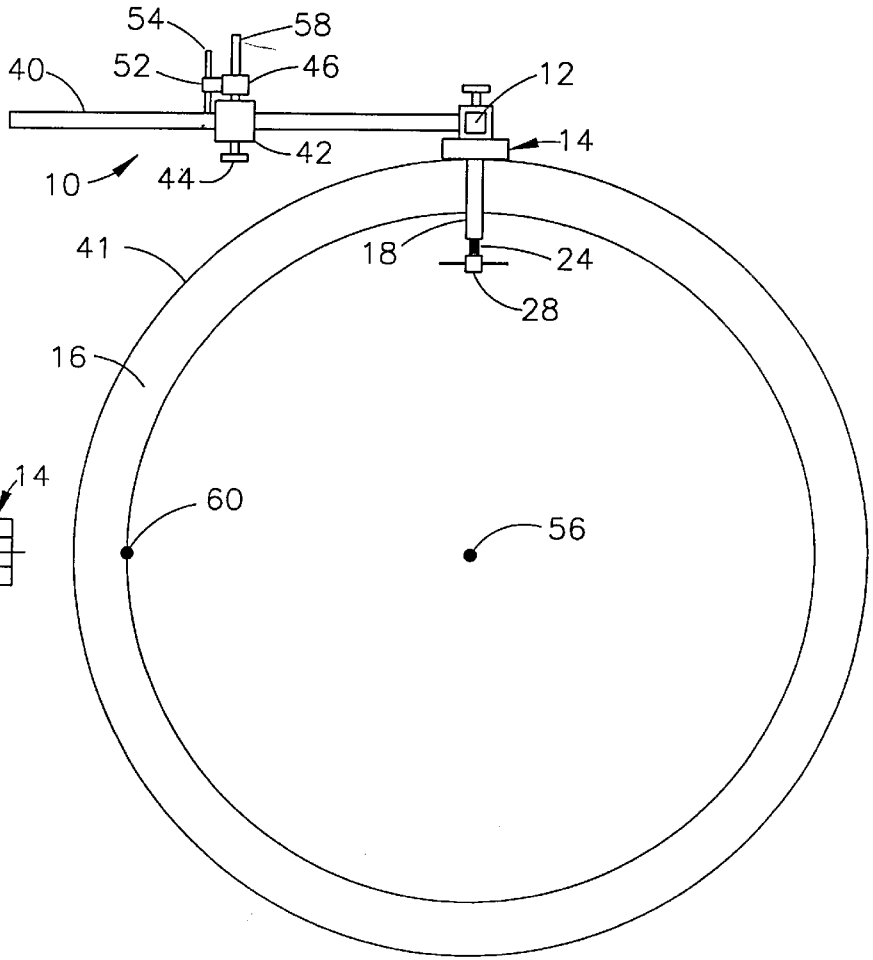
FIG. 2 is an end view of the sewer pipe in FIG. 1.
Figure 1:
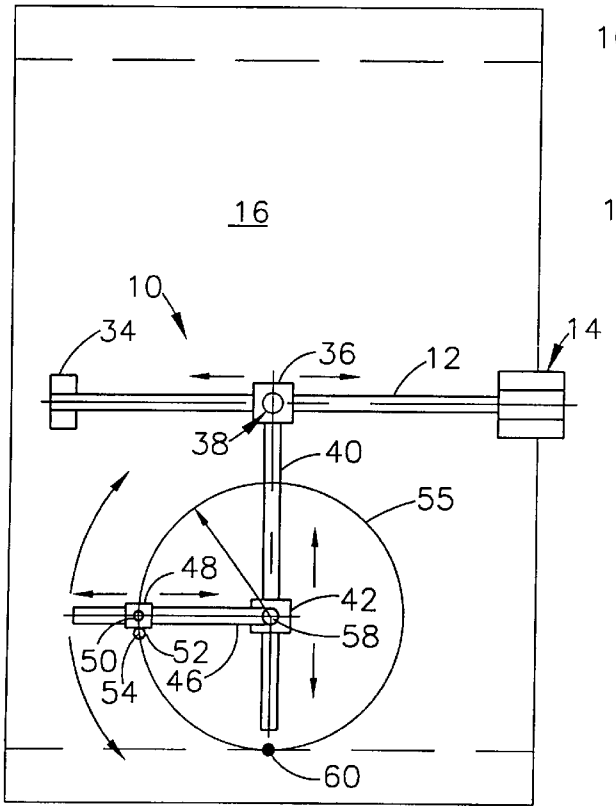
FIG. 1 is a top view of a sewer pipe section to which an apparatus according to the present invention is attached.
Figure 3:
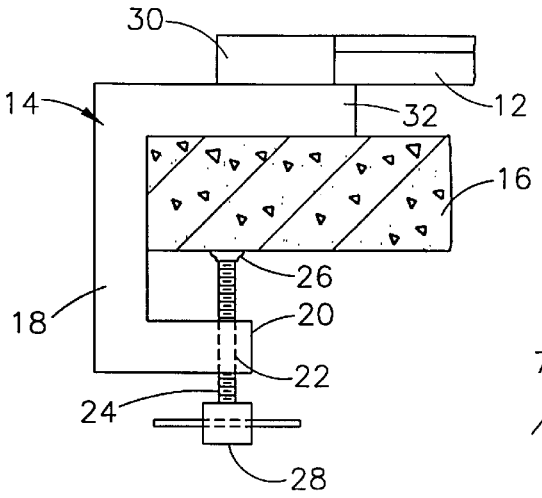
FIG. 3 is a broken away enlargement of the attachment mechanism for the apparatus in FIGS. 1 and 2.

With initial reference to FIGS. 1 and 2, an apparatus 10 is used to mark a line along which a pre-cast section of concrete sewer pipe 16 is to be cut to form an opening therein. The apparatus 10 comprises a longitudinal guide 12, such as a metal or rigid plastic bar or rod, and a support bracket 14 to attach the guide to the concrete sewer pipe 16. The support bracket 14 preferably comprises a C-clamp 18 with the end rim of the sewer pipe 16 extending into the opening of the C as shown in FIG. 3. One leg 20 of the C-clamp extends into the interior of the sewer pipe and has an aperture 22 therethrough. A threaded rod 24 extends through the aperture 22 and has a pad 26 rotatably coupled to the end of the shaft extending into the C-clamp 18. The remote end of the rod 24 has a handle 28 attached thereto enabling the user to turn the shaft. Thus the user is able to tighten the pad 26 against the pipe securely attaching the support bracket 14 to the end of the sewer pipe 16. The other leg 32 of support bracket 14 is attached to the longitudinal guide 12. The other end of the longitudinal guide 12 that is remote from the support bracket 14 has a foot 34 that spaces the longitudinal guide from the surface of the sewer pipe 16.

Referring again to FIGS. 1 and 2, a first sliding bracket 36 has an aperture therethrough within which the longitudinal guide 12 passes. The first sliding bracket 36 is able to move along the longitudinal guide 12 when manipulated by the user. A machine screw 38, with a large head is operable by the fingers of the user, extends through the first sliding bracket 36. By turning the screw 38 inward, the tip of the screw contacts the surface of the longitudinal guide 12 thereby fixing the location of the first sliding bracket 36 along the length of that guide.

A transverse guide 40, such as a metal or rigid plastic bar or rod, extends from the first sliding bracket 36 orthogonally with respect to the longitudinal guide 12. As shown in particular in FIG. 2, the transverse guide 40 is cantilevered from the longitudinal guide 12 over the downwardly curving exterior surface 41 of the pipe 16. A second sliding bracket 42 is mounted on the transverse guide 40 in a sliding fashion and has a second fastening screw 44 extending through its underside thereby enabling the user to fix the position of the second sliding bracket 42 along the length of the transverse guide 40.

A pivot arm 46 has one end pivotally mounted to the top surface of the second sliding bracket 42 enabling the pivot arm to be rotated 360 degrees about the pivot point 58. The pivot arm 46 may be a metal or rigid plastic bar or rod, for example. A third sliding bracket 48 is mounted in a sliding fashion onto the pivot arm 46 and also has a screw for securing the position of the third sliding bracket along the length of the pivot arm 46. The third sliding bracket 48 has a coupling 52 for receiving a small hand held, visible light laser 54. For example, the laser 54 may be a battery powered laser pointer commonly used by lecturers to designate portions of a visual aid, one such device is an LX200 Compact Laser Pointer sold by Radio Shack. The laser 54 is oriented to project a beam of light downward from the apparatus 10 onto the surface of the pipe 16. Although a laser is preferred, other light sources which produce a collimated beam of light can be utilized. In fact other types of position projectors, such as a plumb line, may be employed to transfer the location of the third sliding bracket 48 onto the surface of the pipe 16, as will be described.

The present configuration of apparatus 10 is used to mark a line on the exterior surface of the pipe 16 at which to cut an opening for receiving the riser for a manhole opening. In such a junction the inner surface of the riser should be tangent to point 60 on the inside surface of the pipe 16 so that ladder steps may be provided in the two pieces of pipe enabling a sewer worker to climb into and out of the installed sewer pipe through the manhole riser. Thus the hole to be cut in the pipe is off-center as shown in FIGS. 1 and 2 so as to properly position this tangential meeting of internal surfaces. In this situation the horizontal section of sewer pipe 16 has a significantly larger internal diameter than the riser pipe. For example, the horizontal sewer pipe 16 may have an internal diameter of ten feet with the outside diameter of the riser being four feet. In such a case the pivot point 58 about which the pivot arm 46 rotates should be spaced two feet horizontally from the tangential point 60. In other words, longitudinal guide 12 is positioned directly above the longitudinal axis 56 of the sewer pipe 16 and the second sliding bracket 42 is positioned three feet along the transverse guide 40 from the longitudinal guide 12. The places the pivot point 58 two feet horizontally from the tangent point 60. The third sliding bracket 50 is positioned along the pivot arm 46 a distance from the pivot point 58 equal to the radius of the riser pipe, e.g., two feet.

With the apparatus 10 so positioned, the laser 54 is turned on and the pivot arm 46 slowly rotated in a circle about the pivot point 58. While this is occurring, the light beam traces a line 55 on the curved outer surface of the pipe 16 corresponding to the intersection of the riser pipe in the completed assembly. As the light beam moves, the user employs chalk, a felt-tip pen or other suitable instrument, to mark the cut line 55 on the surface of the pipe. This circular movement of the laser 54 traces a non-circular line 55 on the curved outer surface of the pipe 16 which corresponds to the cut line to be made to provide for an opening receiving the end of the riser pipe for the manhole.

A conventional cutting apparatus is used to cut along the line marked on the pipe 16 to create the opening. Then an inch or two of concrete is removed from the side of the cut opening to expose the wire reinforcing cage or cages within the concrete pipe 16 which will be bent and welded in a conventional manner to the reinforcing mesh of the riser pipe thereby securing the two pipes together. Next the joint is patched with concrete as is typically done in forming pipe sections which were cut by previous methods. In the case of metal or plastic pipes the two sections are welded together.

Figure 9:
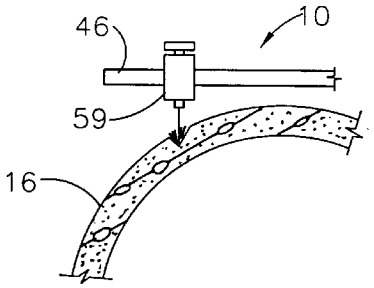
FIG. 9 is a cut-away view showing a pipe cutting device attached to the present apparatus.

Alternatively, as shown in FIG. 9 a pipe cutting device 59, such as a gas torch or high pressure water jet, can be attached to the pivot arm 46. As the pivot arm rotates the cutting line is scribed onto the surface of the pipe 16. In some cases the cutting device 59 may cut entirely through the pipe.

Figure 4:
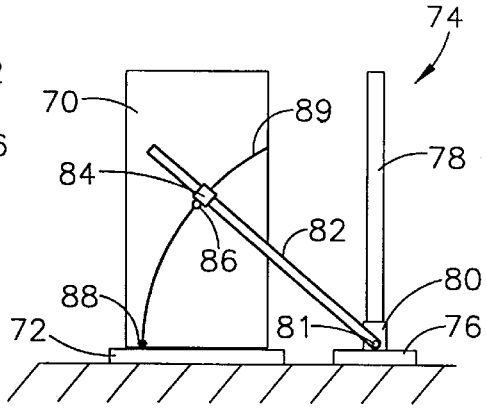
FIG. 4 is a side view of a version of the present apparatus for marking a joint line on a section of pipe to be joined to the pipe section in FIGS. 1 and 2.

FIG. 4 shows a version of the present apparatus which enables the user to mark the curved line at the end of the riser pipe 70 so that it will mate with the opening cut in the horizontal section of pipe 16. The riser pipe 70 is placed on end on a platform 72. The marking apparatus 74 comprises a base plate 76 on the floor of the cutting room and has a vertical guide 78, such as a metal or rigid plastic bar or rod, extending upward from the base plate. A sliding bracket 80 is moveable along the vertical guide 78 and a pivot arm 82 attached pivotally to sliding bracket 80 at point 81. A laser bracket 84 is slidably mounted on pivot arm 82 and thumb-screws enable the positions of brackets 80 and 84 to be fixed along the respective guide 78 or arm 82.

The vertical guide 78 is first positioned horizontally from the riser section 70 so that the distance between the pivot point 81 and the laser bracket 84 is equal to the internal radius of the horizontal sewer pipe 16 to which the riser pipe 70 is to be joined. With the pivot arm 82 in a horizontal position the entire marking apparatus 74 is moved until the light beam from the laser 86 within bracket 84 produces a spot on the remote lower corner 88 of the riser section 70. With the apparatus 74 so positioned, the pivot arm 82 is then raised upward so that the laser light beam traces an arc 89 on the exterior surface of the riser pipe 70. As this is occurring, the user employs a felt-tip pen to mark the arc 89 on the surface of the pipe.

The apparatus 74 then is moved to the back side of the riser pipe 70 and the laser 84 is reversed in the bracket 84 so as to direct its light beam toward the back surface of the riser pipe. The operation then is repeated to trace a corresponding arc on the back side of the surface. The lines so marked on the pipe surface of the riser pipe 70 correspond to the cut which has to be made in order for the lower end of the riser section 70 to mate with the non-circular hole cut in the horizontal pipe section 16 as previously described.

Figure 5:
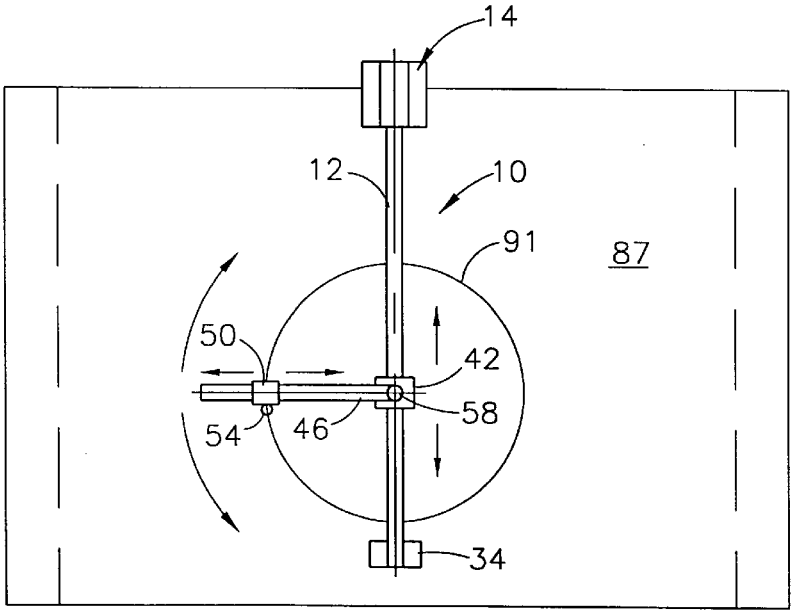
FIG. 5 is a top view of a section of sewer pipe with the present apparatus configured for marking a centered hole on the sewer pipe section.

With reference to FIG. 5, there are occasions when the hole in a section of sewer pipe 87 has to be centered transversely with respect to the outer diameter of the pipe section. In this situation, the longitudinal guide 12, support racket 14 and remote foot 34 are positioned on the pipe 87 in the same manner as is shown in FIGS. 1 and 2. However, the transverse guide 40 and first sliding bracket 36 are not utilized. Instead the second sliding bracket 42 is positioned on the longitudinal guide 12 with the pivot arm 46 extending therefrom. The pivot point 58 is located above the center of the hole to be formed in the pipe 87. The third bracket 50 for the laser 54 is positioned along the pivot arm 48 a distance from pivot point 58 corresponding to the inner diameter of the smaller pipe section to be joined into the opening in pipe 87. Once the apparatus 10 has been properly positioned, the laser 54 is activated and the pivot arm 46 moved to trace the cut line 85 on the surface of the pipe 87 in a manner as described previously. Although viewed from the top the opening appears to be a circle when viewed from above, the actual line is an eclipse on the curved outer surface of the pipe 87.

Figure 6:
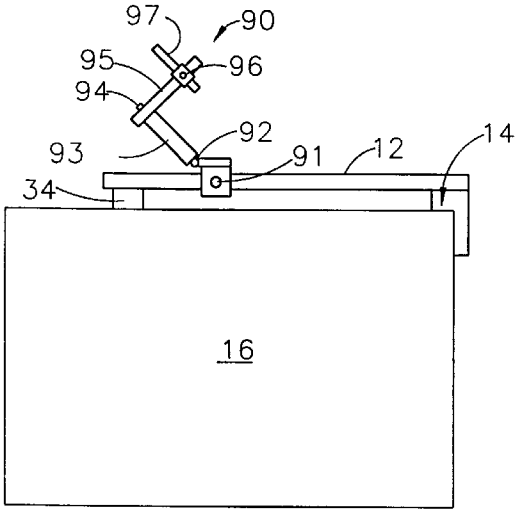
FIG. 6 is a side view of the present apparatus which is modified to mark a cut line at which two sections of pipe are to be joined at an acute angle to form a "Y" fitting.

With reference to FIG. 6, the present apparatus 10 also includes a fitting enabling a cut line to be marked on a section of pipe 16 in order to cut a hole for a lateral pipe to come in at an acute angle thereby forming a "wye" connection. In this instance the longitudinal guide 12 is attached to the pipe 16 by support bracket 14 in the manner described above. However, the components previously coupled to the longitudinal guide 12 have been replaced by the swivel mechanism 90. This mechanism 90 includes a sliding bracket 91 to which a post 93 is attached by a conventional swivel joint 92, which allows the post 93 to pivot about two axes with respect to the sliding bracket 91. The swivel joint 92 also includes a fastening mechanism for securing, or locking, the orientation of the post 93 with respect to the sliding bracket 91. The end of the post 93 remote from the swivel joint 92 has a pivot pin 94 projecting therefrom on which a rotating guide 95 is pivotally attached. A laser bracket 96 is slidably mounted on the rotating bracket 95 and is able to be locked in place by a screw as previously described with respect to sliding brackets in other embodiments. A laser 97 is mounted on the laser bracket 96.

When using the embodiment in FIG. 6, the combination of sliding bracket 91 and pin 94 are positioned so that the longitudinal axis of the post 93 passes through a point on the surface of pipe 16 which corresponds to the intersection of the center line of the lateral pipe to be attached to pipe 16. The longitudinal axis of post 93 also is set at an angle with respect to the pipe section 19 that corresponds to the angle of intersection with the proposed lateral pipe. Once the sliding bracket 91 and post 93 are in the proper orientation, the swivel joint 92 and the sliding bracket 91 are locked in place. The laser bracket 96 then is adjusted so that the laser 97 is positioned from the pivot pin 94 at a distance which corresponds to the radius of the lateral pipe to be connected. The laser 97 then is turned on and rotated about the pivot pin 94 to project its light beam onto the surface of pipe 16. While this is occurring, the user employs a felt-tip pen to mark a line on the pipe as indicated by the laser light beam.

When a pipe installation calls for a bend, a straight section of pipe is cut transversely at an angle to form two pipe portions. One of those portions is then rotated along its longitudinal axis 180 degrees and the two cut edges of the portions are connected together at an angle corresponding to the bend desired in the finished product. The wire reinforcing cages within the two portions are bent and welded together and concrete patching applied over the weld joint to form a unitary bent section of pipe.

Figure 7:
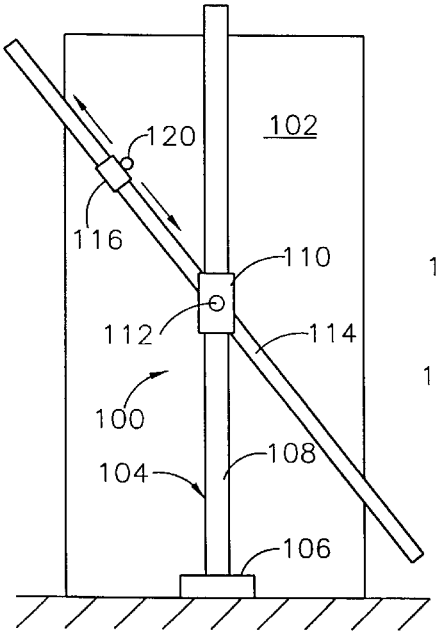
FIG. 7 is a front elevational view of another embodiment of the present apparatus for marking a line along which the sewer pipe is to be cut to form a bent section of sewer pipe.
Figure 8:
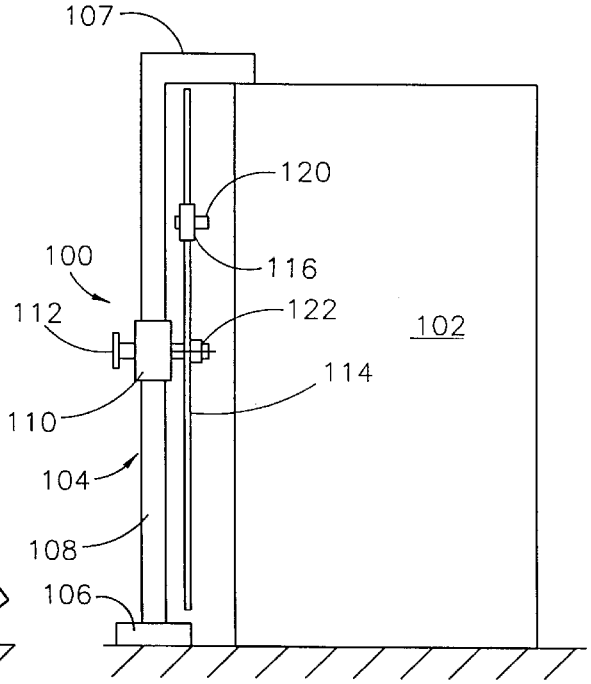
FIG. 8 is a side view of FIG. 5.

FIGS. 7 and 8 show a version of the present apparatus 100 for marking the cut line on a straight section of pipe 102 to form a pipe bend. The apparatus 100 comprises a stand 104 having a base 106 on the floor of the factory and a vertical guide 108 rigidly rising upward from the base 106. A support arm 107 engages the section of pipe 102 to orient the vertical guide 108 with respect to the pipe. The support arm 107 may be separate from and adjustable with respect to the vertical guide 108. A sliding base bracket 110 is movably attached to the vertical guide 108 and has a screw 112 for fastening the base bracket at a vertical position along the guide 108. A transverse guide 114 is pivotally fastened to the base bracket 110. A laser bracket 116 is slidably mounted on the transverse guide 114 and a laser pointer is held within the laser bracket 118.

In use, the vertical guide 108 is positioned adjacent the section of pipe 102. The sliding base bracket 110 is raised to a vertical position corresponding to the vertical center of the cut to be made in the pipe. The transverse guide 114 is rotated to an angle which corresponds to the angle of cut desired to be made across the pipe section 102. When the transverse guide 114 is properly positioned, a fastening mechanism 122 is engaged to fix the angular position of the transverse guide 114 with respect to the vertical guide 108. Once the apparatus 100 has been locked in position, the laser 120 is activated and the laser bracket 116 is slid along the entire length of transverse guide 114 so that the light beam traces a cut line on the outer surface of the pipe section 102. As this is occurring, the user employs a felt-tip pen to mark the cut line on the surface of pipe section 102.

Then the apparatus is moved to the diametrically opposite side of the pipe section 102, the laser 120 is reversed in its bracket 116 and another cut line is drawn on the opposite side of the pipe completely mark the line around the pipe at which the cut is to be made. Thereafter conventional techniques are used to cut and reattach pipe section 102 into a bent section.

The present apparatus, in its different configurations, enables line to be accurately drawn on the surface of a pipe indicating the precise line along which a cut is to be made to form a hole in the pipe for receiving a transverse section of pipe or a transverse line along which a cut is to be made to form a section of pipe for a bend of the desired angle. As a consequence of using this apparatus precise pipe fittings can be fabricated without the previous labor intensive practices.

I claim:

1. An apparatus for indicating lines along which cuts are to be made on a pipe, the apparatus comprising:

a longitudinal guide;

a support attached to the longitudinal guide for orienting the longitudinal guide in a fixed location with respect to the pipe;

a first bracket releasably coupled at one position of a plurality of user selectable positions along the longitudinal guide, and having a first fastener to secure the first bracket at the one position;

a pivot arm pivotally coupled to the first bracket;

a second bracket releasably coupled at a given position of a plurality of user selectable positions along the pivot arm; and a position projector to transfer a location of the second bracket onto a surface of the pipe as the pivot arm moves about the first bracket.

2. The apparatus as recited in claim 1 wherein the position projector comprises a source of a light beam.

3. The apparatus as recited in claim 1 wherein the position projector comprises a laser.

4. The apparatus as recited in claim 1 wherein the position projector comprises a plumb line.

5. The apparatus as recited in claim 1 further comprising a swivel joint coupling the pivot arm to the first bracket.

6. The apparatus as recited in claim 1 further comprising a transverse guide pivotally attached to the first bracket; and a third bracket movably coupled to the transverse guide and having a third fastener to secure the third bracket at one of a plurality of positions along the transverse guide, and the pivot arm being pivotally attached to the third bracket.

7. The apparatus as recited in claim 1 wherein the support comprises a clamp for securing the longitudinal guide to the pipe.

8. The apparatus as recited in claim 7 wherein the clamp is attached adjacent to one end of the longitudinal guide; and further comprising a foot attached adjacent to another end of the longitudinal guide for supporting the longitudinal guide on the pipe.

9. The apparatus as recited in claim 1 further comprising a second fastener to secure the second bracket at the given position.

10. The apparatus as recited in claim 1 wherein the position projector is a device for cutting the pipe.

11. An apparatus for indicating lines along which cuts are to be made on a pipe, the apparatus comprising:

a clamp for attaching to the pipe;

a longitudinal guide fixedly attached to the clamp;

a first bracket slideably coupled to the longitudinal guide and having a first fastener to secure the first bracket at one of a plurality of positions along the longitudinal guide;

a pivot arm pivotally coupled to the first bracket;

a second bracket slideably coupled to the pivot arm and having a second fastener to secure the second bracket at one of a plurality of positions along the pivot arm; and a laser for projecting a beam of light onto a surface of the pipe.

12. A method for indicating lines along which cuts are to be made on a pipe, the method comprising:

locating a longitudinal guide at a fixed position with respect to the pipe;

securing a first bracket at a first position along the longitudinal guide;

securing a second bracket at a second position along a pivot arm which is pivotally coupled to the first bracket; and pivoting the pivot arm about the first bracket while a position projector attached to the second bracket transfers a location of the second bracket onto a surface of the pipe.

13. The method as recited in claim 12 further comprising marking the line traced by the laser beam.

14. The method as recited in claim 12 wherein the step of pivoting the pivot arm comprises the position projector cutting the pipe.

15. An apparatus for indicating lines along which cuts are to be made on a pipe, the apparatus comprising:

a longitudinal guide;

a support attached to the longitudinal guide for orienting the longitudinal guide in a fixed location with respect to the pipe;

a first bracket coupled to the longitudinal guide and movable into a plurality of user selectable positions along the longitudinal guide;

a pivot arm pivotally coupled to the first bracket;

a second bracket coupled to the pivot arm and movable into a plurality of user selectable positions along the pivot arm; and a position projector to transfer a location of the second bracket onto a surface of the pipe as the pivot arm moves about the first bracket.

16. The apparatus as recited in claim 15 wherein the position projector comprises a source of a light beam.

17. The apparatus as recited in claim 15 further comprising a swivel joint coupling the pivot arm to the first bracket.

18. The apparatus as recited in claim 15 further comprising a transverse guide pivotally attached to the first bracket; and a third bracket coupled to the transverse guide and moveable into a plurality of positions along the transverse guide, and the pivot arm being pivotally attached to the third bracket.

19. The apparatus as recited in claim 15 wherein the support comprises a clamp for securing the longitudinal guide to the pipe.

20. The apparatus as recited in claim 19 wherein the clamp is attached adjacent to one end of the longitudinal guide; and further comprising a foot attached adjacent to another end of the longitudinal guide for supporting the longitudinal guide on the pipe.

* * * * *